US008210834B2

(12) United States Patent
Tsai

(10) Patent No.: US 8,210,834 B2
(45) Date of Patent: Jul. 3, 2012

(54) AIR PUMP FOR INFLATABLE ARTICLE

(75) Inventor: Chun-Chung Tsai, Dongguan (CN)

(73) Assignee: Dongguan Tiger Point, Metal & Plastic Products Co., Ltd., Guang Dong Province (CN)

( * ) Notice: Subject to any disclaimer, the term of this patent is extended or adjusted under 35 U.S.C. 154(b) by 440 days.

(21) Appl. No.: 12/508,016

(22) Filed: Jul. 23, 2009

(65) Prior Publication Data

US 2011/0020149 A1 Jan. 27, 2011

(51) Int. Cl.
*F04B 35/04* (2006.01)

(52) U.S. Cl. ..... 417/423.14; 417/315; 5/713

(58) Field of Classification Search ..... 417/321, 417/239, 315, 423.1, 423.14; 5/706, 713, 5/714; 415/206
See application file for complete search history.

(56) References Cited

U.S. PATENT DOCUMENTS 6,679,686 B2 * 1/2004 Wang ..... 417/423.1
6,955,529 B2 * 10/2005 Tsai ..... 417/423.15
7,128,525 B2 * 10/2006 Tsai ..... 415/128

* cited by examiner

*Primary Examiner* — Charles Freay
*Assistant Examiner* — Todd D Jacobs
(74) *Attorney, Agent, or Firm* — WPAT, P.C.; Anthony King

(57) ABSTRACT

An air pump for an inflatable article has a housing, and a blower, a switch assembly, an air valve and a fan guard mounted in the housing. The switch assembly has a slider and a driving device sliding the slider and the air valve to switch operating modes of the air pump. Thus, the air pump inflates or deflates the inflatable article or maintains or fine-tunes the air pressure inside the inflatable article. Therefore, the first and second openings of the housing are disposed on the housing for connection to different kinds of inflatable articles and the airflow directly flows through the air pump so inflating and deflating the inflatable article is fast.

6 Claims, 11 Drawing Sheets

AIR PUMP FOR INFLATABLE ARTICLE

BACKGROUND OF THE INVENTION

1. Field of the Invention

The present invention relates to an air pump for an inflatable article, especially to a compact air pump with rapid rate of inflation.

2. Description of the Prior Art(s)

Air pumps are connected to inflatable articles such as airbeds, inflatable trampolines, inflatable sofas, large-sized inflatable toys and the like and inflate or deflate the inflatable articles for use or storage.

The conventional air pump for the inflatable article has a housing having an impeller, a motor, an electromagnetic valve, an air valve and a slider mounted in the housing. The housing has an inner hole formed through a sidewall of the housing and an outer hole formed through a bottom of the housing. The motor is connected to and rotates the impeller at high speed to create an airflow. The electromagnetic valve has a shaft. The air valve is connected to an end of the shaft of the electromagnetic valve and corresponds to the inner hole of the housing. The slider is connected to another end of the shaft of the electromagnetic valve and corresponds to the outer hole of the housing.

As the motor rotates the impeller, the electromagnetic valve controls the air valve to selectively open or close the inner hole of the housing and simultaneously the electromagnetic valve slides the slider to switch directions of the airflow to inflate or deflate an inflatable article.

However, since the air valve and the slider are both driven by the shaft of the electromagnetic valve, the inner and outer holes of the housing have to be formed respectively on the sidewall and the bottom of the housing. Thus, while inflating, the airflow flows from the bottom toward the sidewall of the housing. As a path of the airflow is curved, flowing distance and resistance of the airflow in the housing are increased. Therefore, inflating the inflatable article with the conventional air pump is slow.

To overcome the shortcomings, the present invention provides an air pump for an inflatable article to mitigate or obviate the aforementioned problems.

SUMMARY OF THE INVENTION

The main objective of the present invention is to provide an air pump for an inflatable article. The air pump has a housing, and a blower, a switch assembly, an air valve and a fan guard mounted in the housing. The switch assembly has a slider and a driving device sliding the slider and the air valve to switch operating modes of the air pump.

Thus, the air pump inflates or deflates the inflatable article or maintains or fine-tunes the air pressure inside the inflatable article. Therefore, the first and second openings of the housing are disposed on the housing for connection to inflatable articles and the airflow flows directly through the air pump so inflating and deflating the inflatable article is fast.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
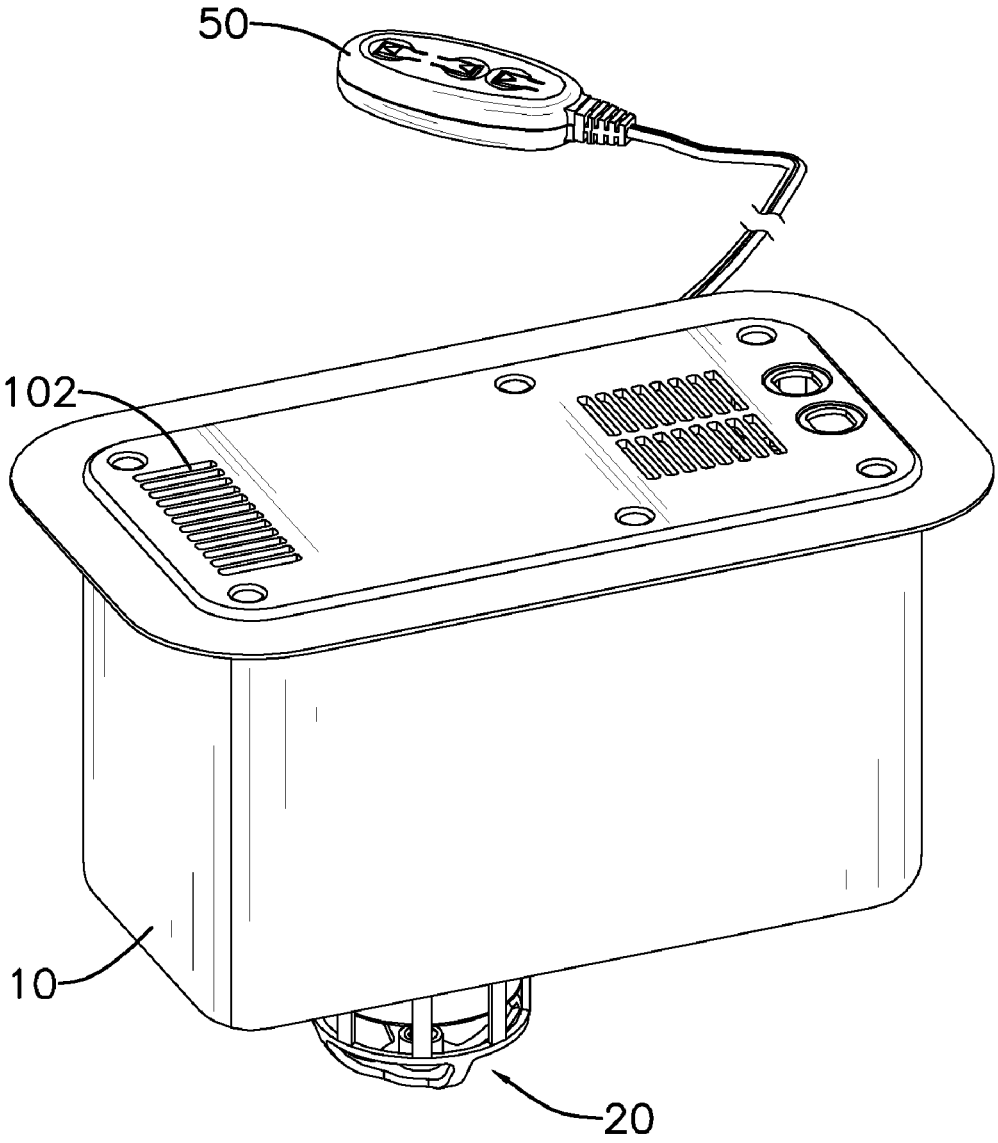
FIG. 1 is a perspective view of a first embodiment of an air pump for an inflatable article in accordance with the present invention.
Figure 2:
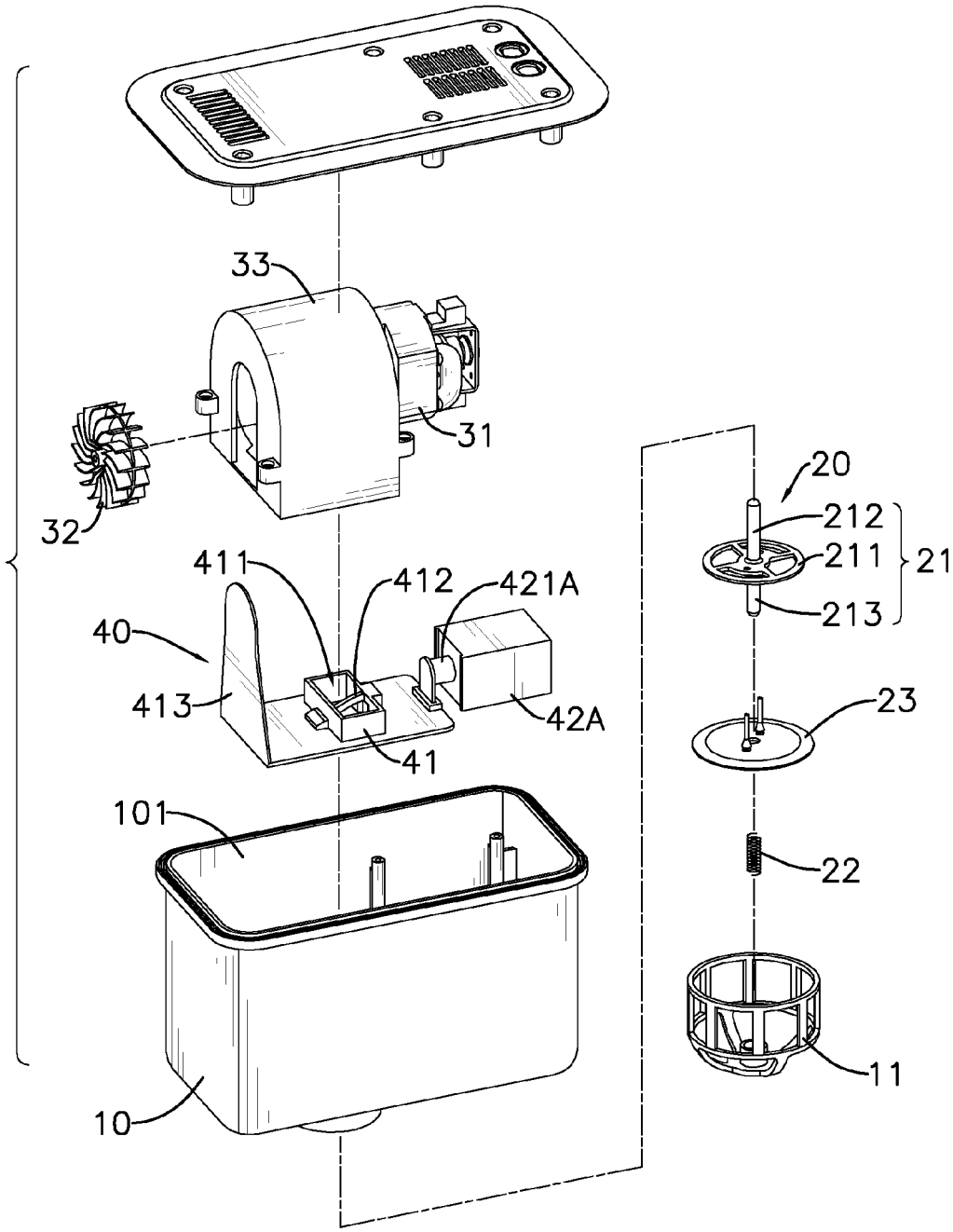
FIG. 2 is an exploded perspective view of the air pump in FIG. 1.

With reference to FIGS. 1 and 2, an air pump for an inflatable article in accordance with the present invention comprises a housing (10), a blower (30), a switch assembly (40) and an air valve (20) and may comprise a fan guard (11).

Figure 3:
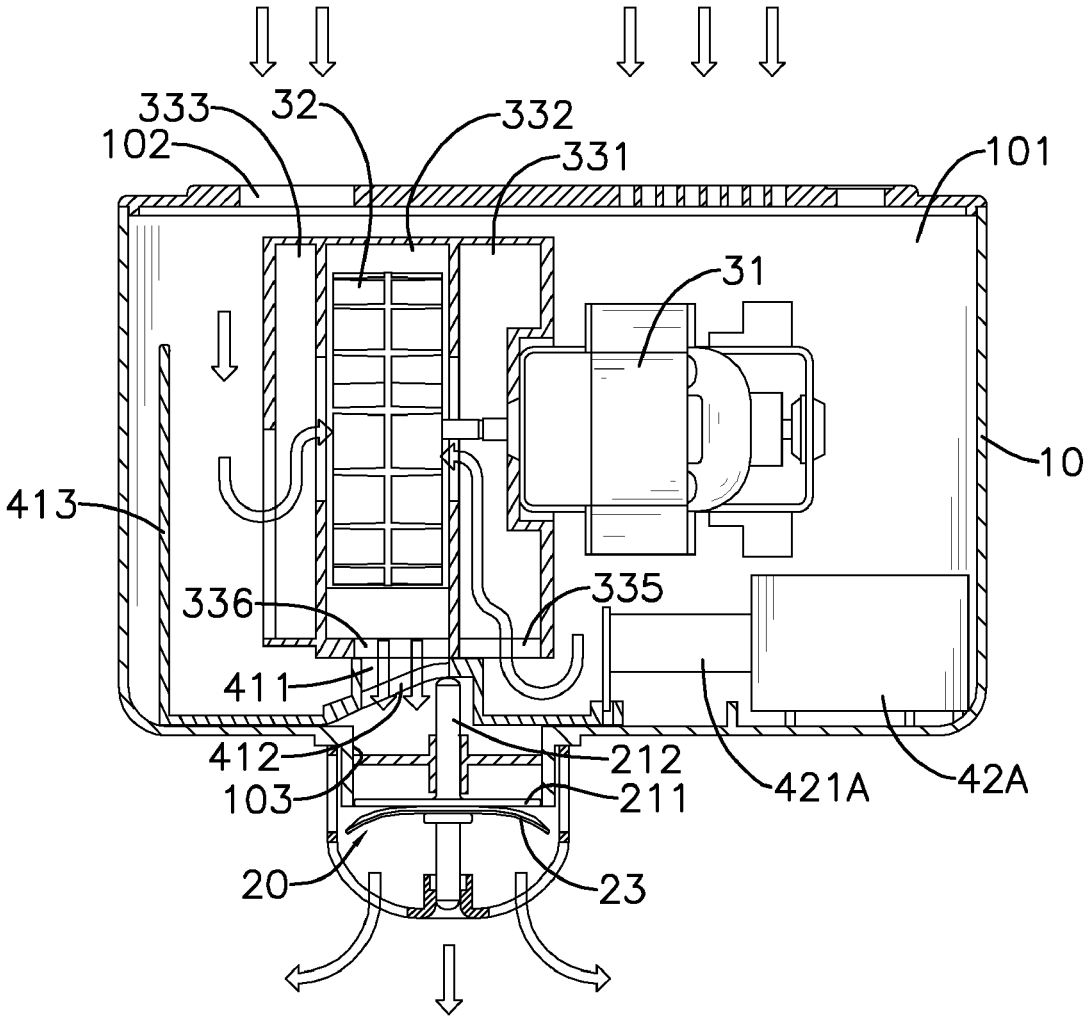
FIG. 3 is an operational side view in partial section of the air pump in FIG. 1, shown inflating.

With further reference to FIG. 3, the housing (10) is mounted on the inflatable article and has an inner chamber (101), a first opening (102) and a second opening (103). The inner chamber (101) is defined in the housing (10). The first opening (102) is formed through a top of the housing (10), communicates with the inner chamber (101) of the housing (10) and is disposed outside the inflatable article. The second opening (103) is formed through a bottom of the housing (10), aligns with the first opening (102) of the housing (10), is disposed inside the inflatable article and communicates with the inner chamber (101) of the housing (10) and the inflatable article.

Figure 4:
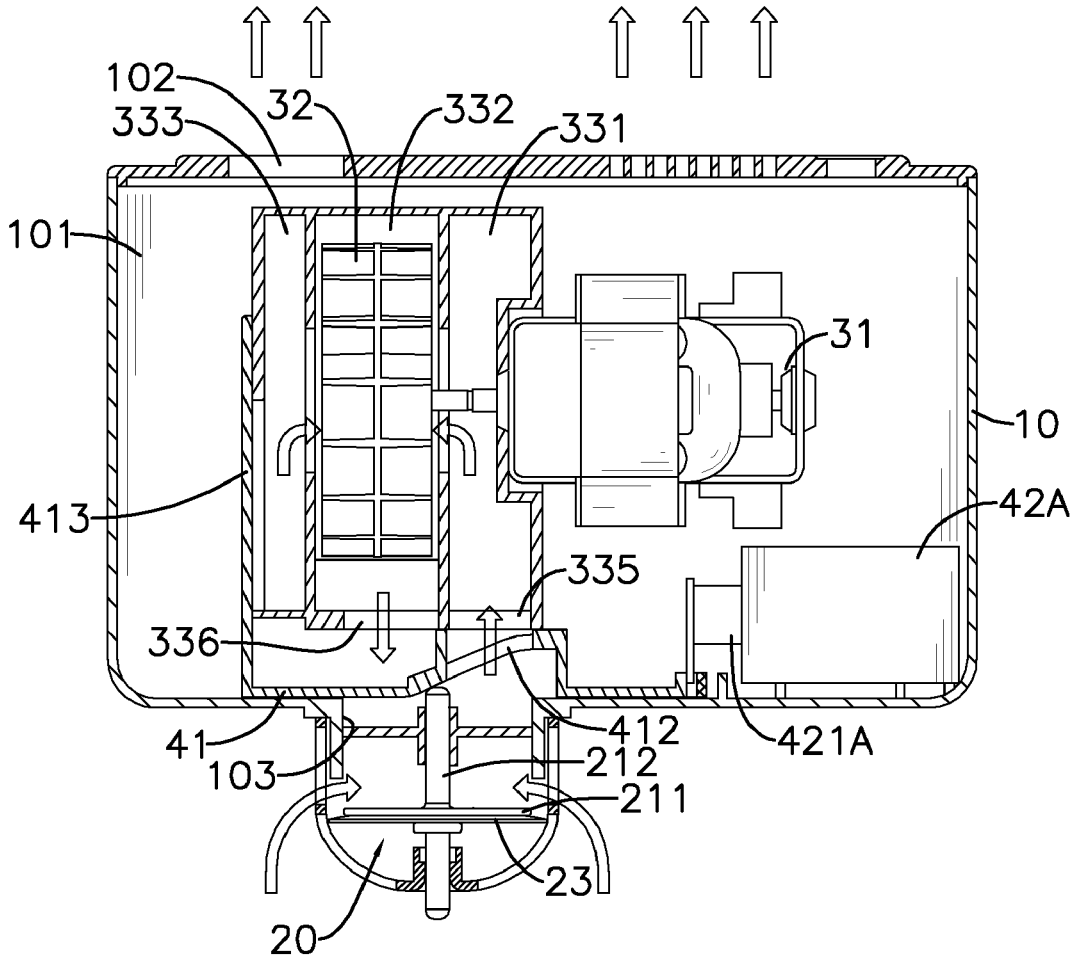
FIG. 4 is an operational side view in partial section of the air pump in FIG. 1, shown deflating.
Figure 5:
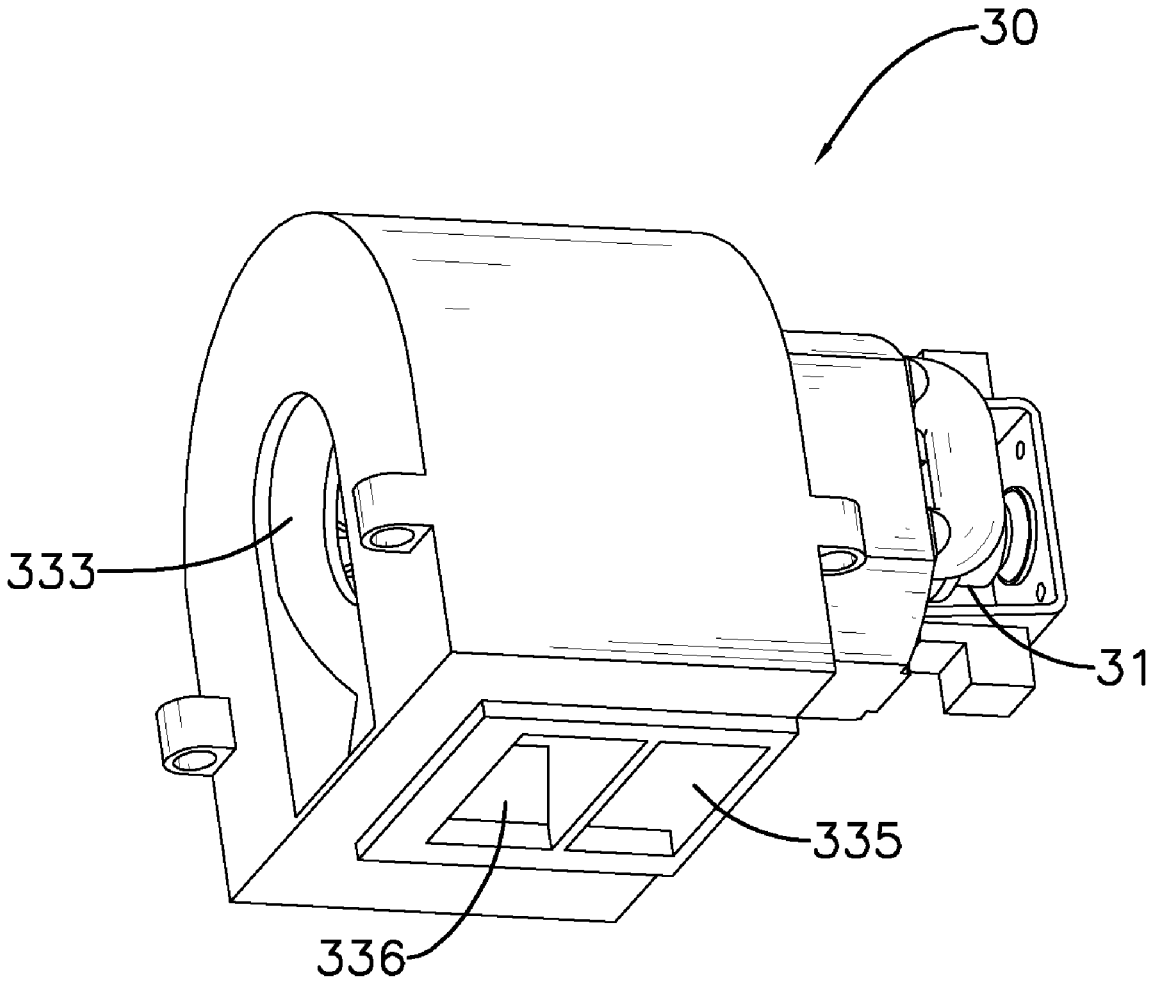
FIG. 5 is an enlarged perspective view of a blower of the air pump in FIG. 1.

With further reference to FIGS. 4 and 5, the blower (30) is mounted in the inner chamber (101) of the housing (10) and has a casing (33), a motor (31) and a dual-side impeller (32).

Figure 6:
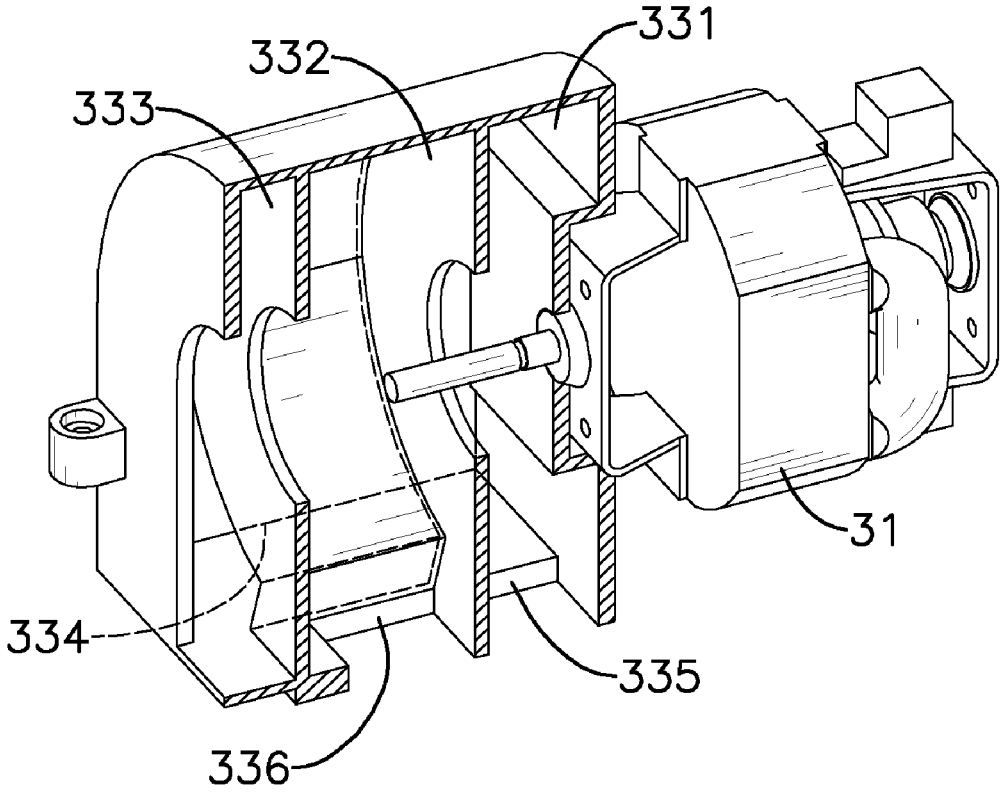
FIG. 6 is a partial cross-sectional perspective view of the blower in FIG. 5.

With further reference to FIG. 6, the casing (33) has a first air chamber (331), a second air chamber (332), an optional third air chamber (333), an optional side air chamber (334), an air inlet (335) and an air outlet (336).

The first air chamber (331) is formed adjacent to a front end of the casing (33). The second air chamber (332) is formed adjacent to and communicates with the first air chamber (331). The third air chamber (333) is formed between the second air chamber (332) and a rear end of the casing (33) and communicates with the second air chamber (332) and the inner chamber (101) of the housing (10). The side air chamber (334) is formed beside the second air chamber (332) and communicates with the first and third air chamber (331, 333).

The air inlet (335) is formed through a sidewall of the casing (33) and communicates with the first air chamber (331) of the casing (33). The air outlet (336) is formed through the sidewall of the casing (33) and communicates with the second air chamber (332) of the casing (33).

The motor (31) may be controlled by a controller (50), is mounted securely on the front end of the casing (33) and has a shaft (311). The shaft (311) is mounted through the front end of the casing (33) and the first air chamber (331) and protrudes to the second air chamber (332) of the casing (33).

Figure 8:
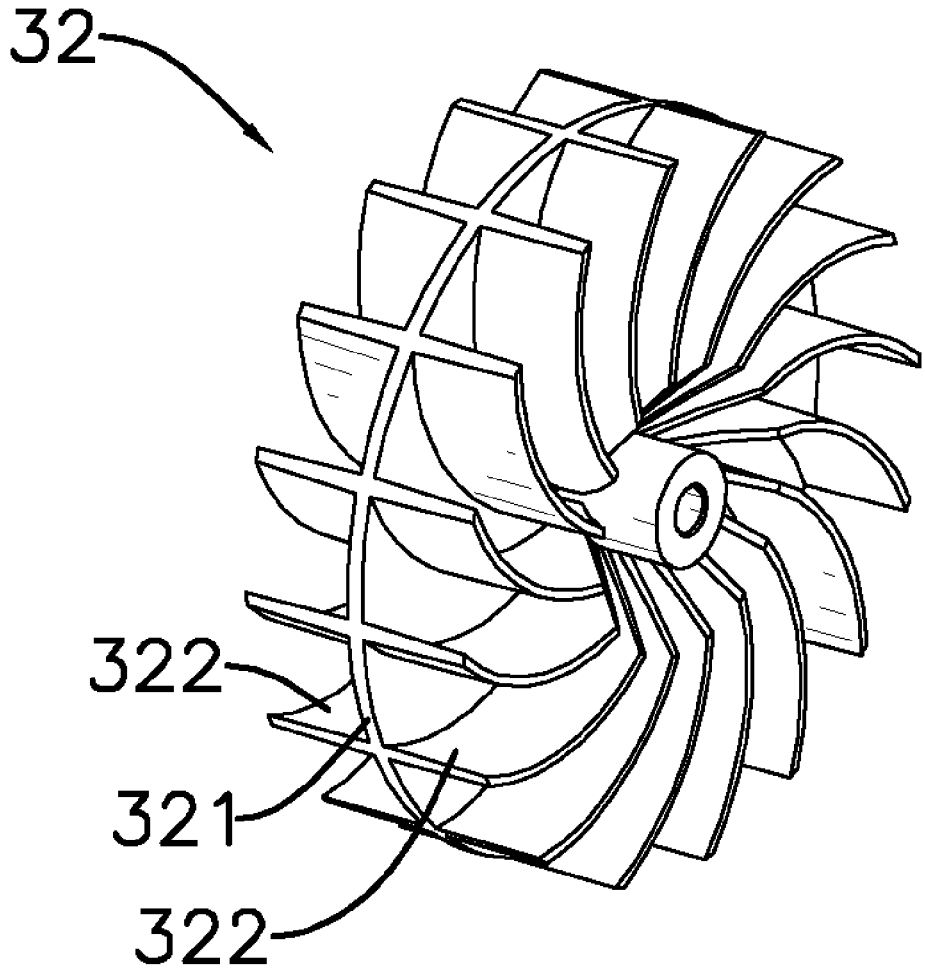
FIG. 8 is an enlarged perspective view of an impeller of the air pump in FIG. 1.

With further reference to FIG. 8, the dual-side impeller (32) is disposed in the second air chamber (332) of the casing (33), is mounted securely on the shaft (311) of the motor (31), allows the air to be pumped and may have a panel (321) and multiple blades (322). The panel (321) is mounted securely on the shaft (311) of the motor (31). The blades (322) are formed perpendicularly on two opposite side surfaces of the panel (321). Thus, the motor (31) rotates the impeller (32) at high speed and creates an airflow.

The switch assembly (40) is mounted slidably in the inner chamber (101) of the housing (10) and between the blower (30) and the bottom of the housing (10) and has a slider (41) and a driving device.

Figure 7:
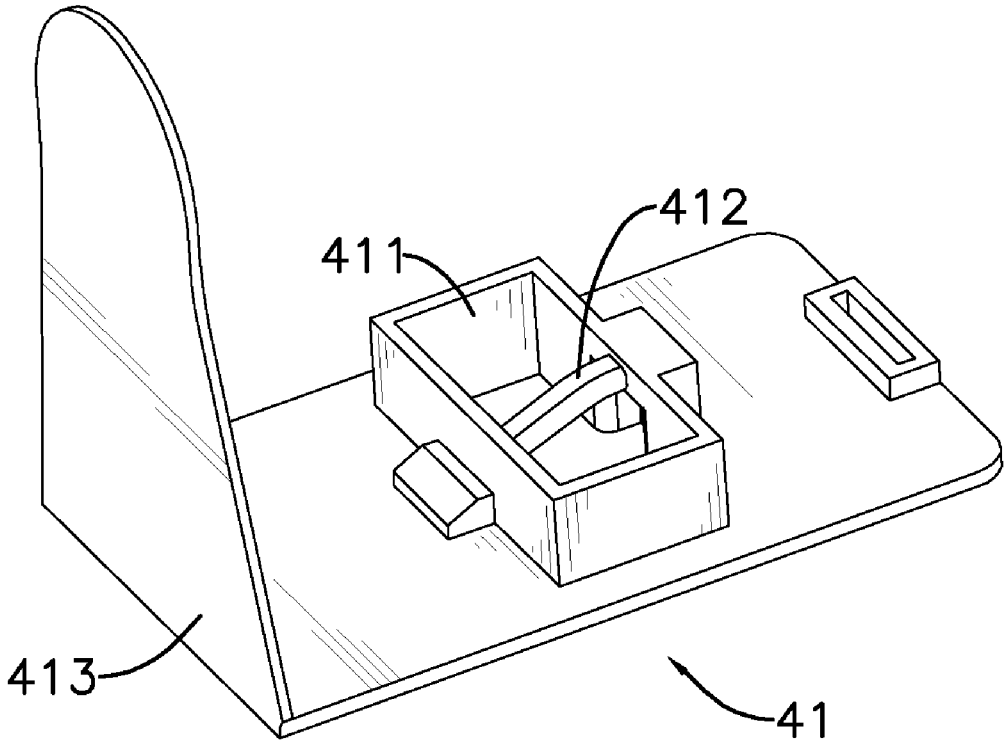
FIG. 7 is an enlarged perspective view of a slider of the air pump in FIG. 1.

With further reference to FIG. 7, the slider (41) has a switching hole (411), an inner sidewall and a guider (412) and may have a cover (413). The switching hole (411) is formed through the slider (41), corresponds to the second opening (103) of the housing (10) and aligns with either the air inlet (335) or the air outlet (336) of the casing (33). The inner sidewall of the slider (41) is defined around the switching hole (411) of the slider (41). The guider (412) is obliquely disposed in the switching hole (411) and has an upper end and a lower end. The upper end and the lower end of the guider (412) are in opposite directions and are connected to the inner sidewall of the slider (41). The cover (413) is formed longitudinally on the slider (41), selectively abuts and covers the rear end of the casing (33) of the blower (30) when the switch hole (411) of the slider (41) aligns with the air inlet (335) of the casing (33).

The driving device is connected to the slider (41) and slides the slider (41) back and forth.

With reference to FIG. 2, in a first preferred embodiment, the driving device is an electromagnetic valve (42A). The electromagnetic valve (42A) may be controlled by the controller (50) is mounted securely on the housing (10) in the inner chamber (101) of the housing (10) and has a rod (421A). The rod (421A) is retractably attached to the slider (41) to slide the slider (41) back and forth.

Figure 9:
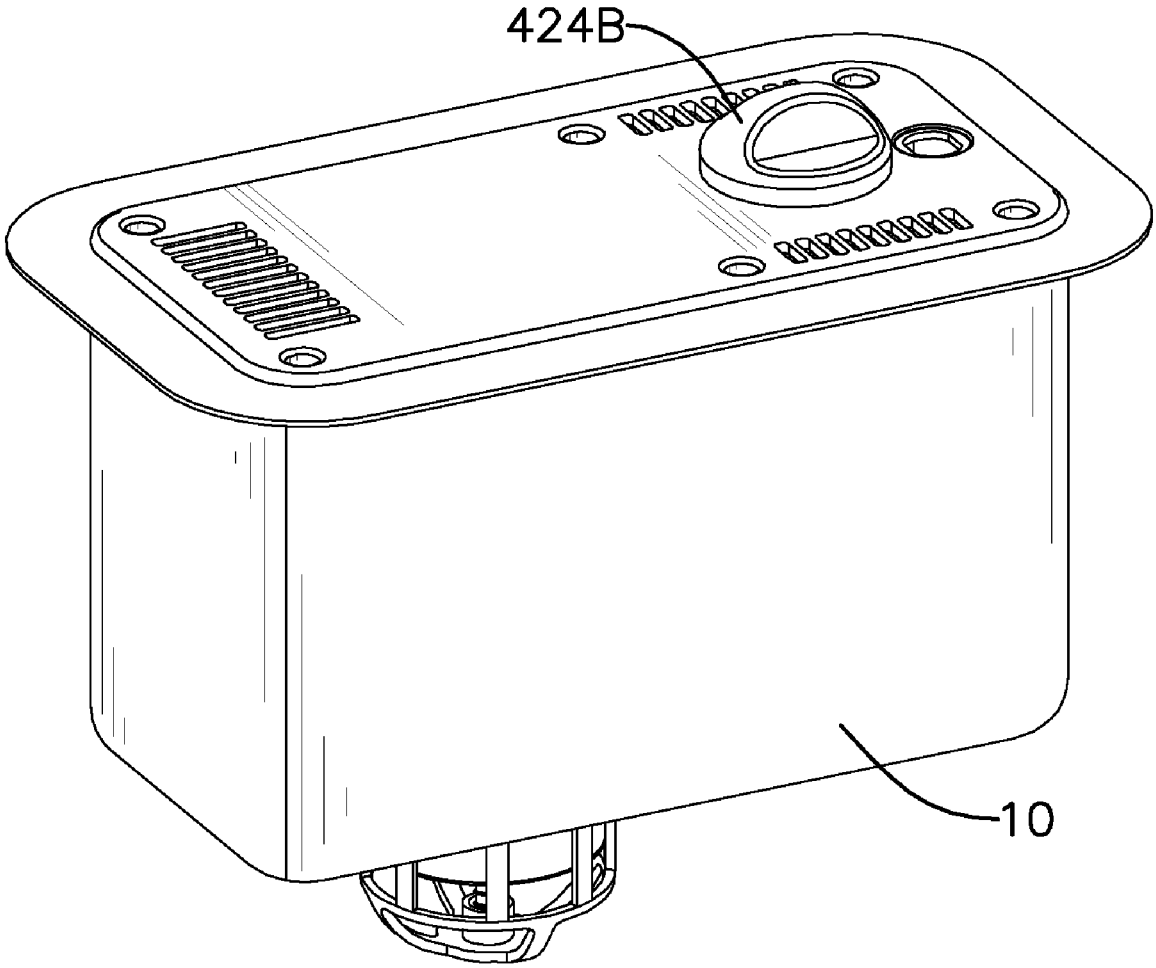
FIG. 9 is a perspective view of a second embodiment of an air pump for an inflatable article in accordance with the present invention.
Figure 10:
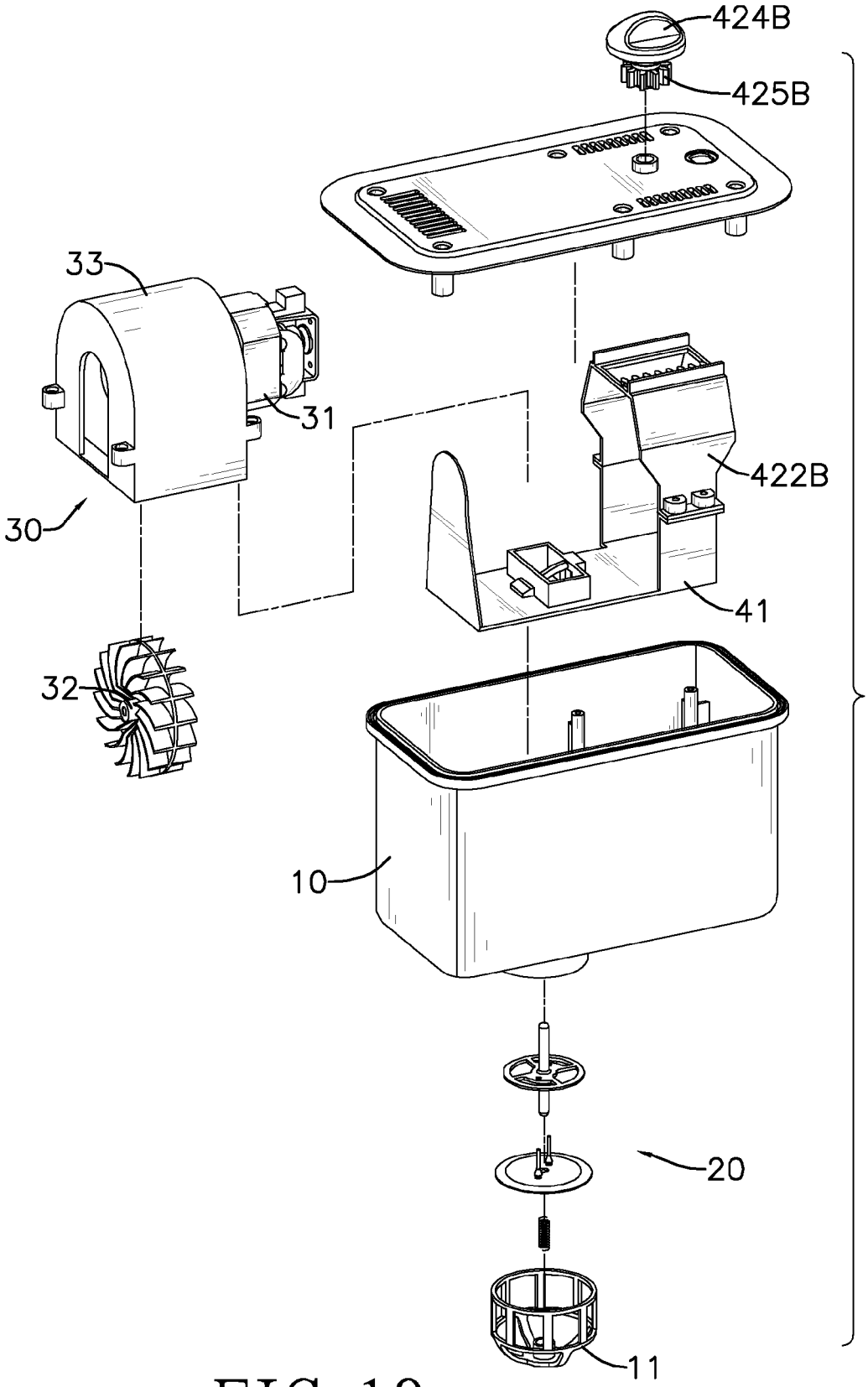
FIG. 10 is an exploded perspective view of the air pump in FIG. 9.
Figure 11:
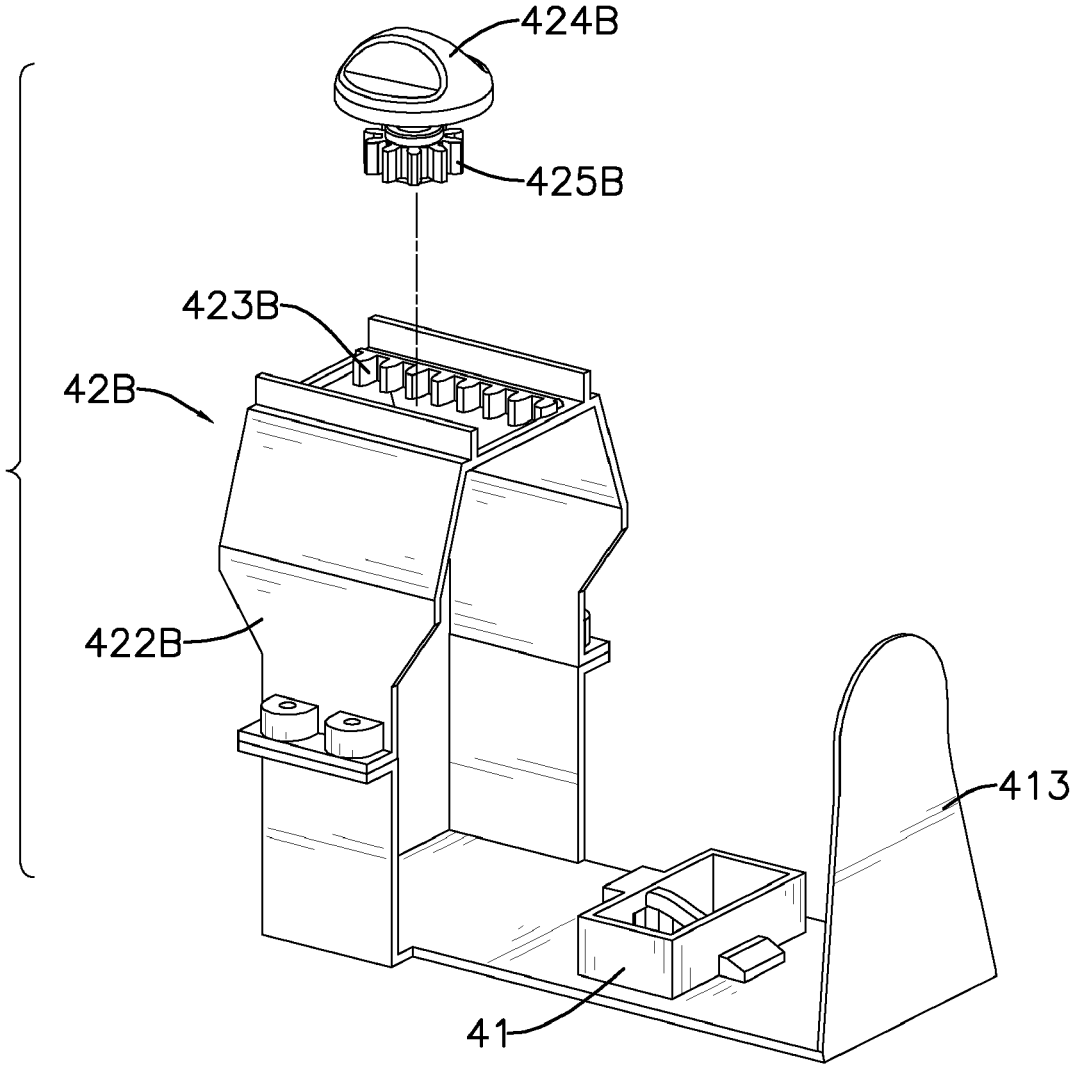
FIG. 11 is an enlarged perspective view of a switch assembly of the air pump in FIG. 9.

With further reference to FIGS. 9 to 11, in a second preferred embodiment, the driving device is a gear set (42B). The gear set (42B) has a driven bracket (422B) and a knob (424B). The driven bracket (422B) is attached on the slider (41) and has a rack (423B). The rack (423B) is formed on a top of the driven bracket (422B). The knob (424B) is mounted on the top of the housing (10) and has a gear (425B). The gear (425B) engages the rack (423B). As the knob (424B) is turned, the slider (41) slides back and forth.

The air valve (20) is mounted on the bottom of the housing (10) through the second opening (103) of the housing (10), selectively seals the second opening (103) of the housing (10) and may have a supporter (21), a seal (23) and a resilient component (22).

The supporter (21) has a disk (211), an upper pintle (212) and a lower pintle (213). The disk (211) is mounted in the second opening (103) of the housing (10). The upper pintle (212) is longitudinally formed axially from an upper surface of the disk (211) and has a distal end. The distal end of the upper pintle (212) abuts the guider (412) of the slider (41). The lower pintle (213) is longitudinally formed axially from a lower surface of the disk (211).

The seal (23) is a disk, is rubber, is mounted on the lower surface of the disk (211) and selectively abuts the bottom of the housing (10) to seal the second opening (103) of the housing (10).

The resilient component (22) is mounted around the lower pintle (213) of the supporter (21) and abuts the seal (23).

The fan guard (11) is mounted on the bottom of the housing (10) around the air valve (20) and abuts the resilient component (22) of the air valve (20) to allow the disk (211) of the air valve (20) to securely abut the housing (10).

The air pump inflates the inflatable article, maintains air pressure of the inflatable article, deflates the inflatable article and fine-tunes the air pressure inside the inflatable article.

With reference to FIG. 3, while inflating the inflatable article, the electromagnetic valve (42A) slides the slider (41) to allow the switching hole (411) of the slider (41) to align with the air outlet (336) of the casing (33) and the cover (413) of the slider (41) departs from the rear end of the casing (33) of the blower (30). Then, the distal end of the upper pintle (212) of the supporter (21) of the air valve (20) abuts the upper end of the guider (412), the seal (23) abuts the bottom of the housing (10) and the first and third air chambers (331, 333) communicate with the inner chamber (101) of the housing (10). Thus, the air outside the inflatable article flows through the first opening (102) and the inner chamber (101) of the housing (10) and the air inlet (335) of the casing (33) of the blower (30) and flows into the first and third chambers (331, 333) and then the second air chamber (332) of the casing (33). With the impeller (32) rotated by the motor (31), the air flows out of the second air chamber (332) through the air outlet (336) of the casing (33), flows through the second opening (103) of the housing (10) and then pushes the seal (23) and inflates the inflatable article.

After the inflatable article is inflated, the air pressure inside the inflatable article is higher than air pressure outside the inflatable article. Therefore, once the motor (31) stops and the switching hole (411) of the slider (41) still aligns with the air outlet (336) of the casing (33) of the blower (30), the air pressure inside the inflatable article forces the seal (23) to abut the bottom of the housing (10) tightly and seal the second opening (103) of the housing (10) securely. Thus, the air pressure of the inflatable article is maintained.

With further reference to FIG. 4, while deflating the inflatable article, the electromagnetic valve (42A) slides the slider (41) to allow the switching hole (411) of the slider (41) to align with the air inlet (335) of the casing (33) and the cover (413) of the slider (41) abuts and covers the rear end and the third air chamber (333) of the casing (33). Then, the distal end of the upper pintle (212) of the supporter (21) of the air valve (20) abuts the lower end of the guider (412) and the disk (211) of the supporter (21), the seal (23) depart from the sidewall of the housing (10) and the second air chamber (332) of the casing (33) communicates with the inner chamber (101) of the housing (10). Thus, the air inside the inflatable article flows through the second opening (103) of the housing (10) and the air inlet (335) of the casing (33), flows into the first air chamber (331) and then the second air chamber (332) of the casing (33). Furthermore, the air flows into the first air chamber (331) also flows through the side air chamber (334) of the casing (33) to the third air chamber (333) of the casing (33) and then flows into the second air chamber (332) of the casing (33). Thus, rate of deflation of the inflatable article is increased and heat generated by the motor (31) is also dissipated. Then, with the impeller (32) rotated by the motor (31), the air flows through the air outlet (336) of the casing (33) and then into the inner chamber (101) of the housing (10) and flows out of the housing (10) through the first opening (102) of the housing (10).

To fine-tuning the air pressure inside the inflatable article, the motor (31) is turned off and the slider (41) set in a deflating position as described. Then, since the air pressure inside the inflatable article is higher than the air pressure outside the inflatable article, the air inside the inflatable article still flows out of the inflatable article through the air pump slowly. Therefore, the air pressure inside the inflatable article can be adjusted finely.

The air pump for the inflatable article as described has the following advantages. The driving device slides the slider (41) and the guider (412) of the slider (41) pushes the air valve (20) to switch operating modes of the air pump. Therefore, the first and second openings (102, 103) of the housing (10) are disposed on the housing (10) appropriate to different kinds of inflatable articles. For example, the first and second openings (102, 103) of the housing (10) are directly opposite to each other in the preferred embodiment as described. Therefore, the airflow flows through the air pump directly and inflating or deflating the inflatable article is fast.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An air pump comprising:

a housing having an inner chamber defined in the housing;

a first opening formed through a top of the housing and communicating with the inner chamber of the housing; and a second opening formed through a bottom of the housing, aligning with the first opening of the housing and communicating with the inner chamber of the housing;

a blower mounted in the inner chamber of the housing and having a casing having a first air chamber formed adjacent to a front end of the casing;

a second air chamber formed adjacent to and communicating with the first air chamber;

an air inlet formed through a sidewall of the casing and communicating with the first air chamber of the casing; and an air outlet formed through the sidewall of the casing and communicating with the second air chamber of the casing;

a motor mounted securely on the front end of the casing and having a shaft mounted through the front end of the casing and the first air chamber and protruding to the second air chamber of the casing; and a dual-side impeller disposed in the second air chamber of the casing and mounted securely on the shaft of the motor;

a switch assembly mounted slidably in the inner chamber of the housing and between the blower and the bottom of the housing and having a slider having a switching hole formed through the slider, corresponding to the second opening of the housing and aligning with either the air inlet or the air outlet of the casing;

an inner sidewall defined around the switching hole of the slider; and a guider obliquely disposed in the switching hole and having an upper end and a lower end being in opposite directions and connected to the inner sidewall of the slider; and a driving device connected to the slider and sliding the slider back and forth;

an air valve mounted on the bottom of the housing through the second opening of the housing, selectively sealing the second opening of the housing and having a supporter having a disk mounted in the second opening of the housing;

an upper pintle longitudinally formed axially from an upper surface of the disk and having a distal end abutting the guider of the slider; and a lower pintle longitudinally formed axially from a lower surface of the disk;

a seal being a disk, being rubber, mounted on the lower surface of the disk of the supporter and selectively abutting the bottom of the housing; and a resilient component mounted around the lower pintle of the supporter and abutting the seal; and a fan guard mounted on the bottom of the housing around the air valve and abutting the resilient component of the air valve.

2. The air pump as claimed in claim 1, wherein the driving device of the switch assembly is an electromagnetic valve mounted securely on the housing in the inner chamber of the housing and has a rod retractably attached to the slider.

3. The air pump as claimed in claim 1, wherein the driving device of the switch assembly is a gear set having a driven bracket attached on the slider and having a rack formed on a top of the driven bracket; and a knob mounted on the top of the housing and having a gear engaging the rack.

4. The air pump as claimed in claim 1, wherein the casing of the blower further has a third air chamber formed between the second air chamber and a rear end of the casing and communicating with the second air chamber and the inner chamber of the housing; and the slider of the switch assembly further has a cover formed longitudinally on the slider, selectively abutting and covering the rear end of the casing of the blower when the switch hole of the slider aligns with the air inlet of the casing.

5. The air pump as claimed in claim 4, wherein the casing of the blower further has a side air chamber formed beside the second air chamber and communicating with the first and third air chambers.

6. The air pump as claimed in claim 1, wherein the impeller of the blower further has a panel mounted securely on the shaft of the motor; and multiple blades formed perpendicularly on two opposite side surfaces of the panel.

* * * * *